US008995855B2

(12) United States Patent
Yamada

(10) Patent No.: US 8,995,855 B2
(45) Date of Patent: Mar. 31, 2015

(54) PRINTING DEVICE THAT EXECUTES CALIBRATION AT FREQUENCY SUITED TO USER DEMAND

(75) Inventor: Akihiro Yamada, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 63 days.

(21) Appl. No.: 12/849,693

(22) Filed: Aug. 3, 2010

(65) Prior Publication Data

US 2011/0128559 A1 Jun. 2, 2011

(30) Foreign Application Priority Data

Nov. 30, 2009 (JP) ..... 2009-271592

(51) Int. Cl.

| | |
|---|---|
| ***G06K 15/02*** | (2006.01) |
| ***H04N 1/60*** | (2006.01) |
| ***H04N 1/52*** | (2006.01) |
| ***G03G 15/00*** | (2006.01) |

(52) U.S. Cl.

CPC .. *G03G 15/5058* (2013.01); *G03G 2215/00059* (2013.01); *G03G 2215/00063* (2013.01); *G03G 2215/0161* (2013.01); *G03G 2215/0164* (2013.01)

USPC ..... 399/49; 358/1.15; 358/1.13; 358/1.9

(58) Field of Classification Search

USPC ..... 399/49

See application file for complete search history.

(56) References Cited

U.S. PATENT DOCUMENTS

| | | | | |
|---|---|---|---|---|
| 5,815,768 | A * | 9/1998 | Clifton | 399/27 |
| 6,280,105 | B1 * | 8/2001 | Iida | 400/74 |
| 6,341,203 | B1 * | 1/2002 | Nakazato et al. | 399/49 |
| 6,418,281 | B1 * | 7/2002 | Ohki | 399/49 |
| 2004/0114965 | A1 * | 6/2004 | Itoh | 399/258 |
| 2004/0125392 | A1 * | 7/2004 | Ohmori | 358/1.9 |
| 2006/0140650 | A1 * | 6/2006 | Yokote | 399/27 |
| 2007/0134012 | A1 * | 6/2007 | Suzuki et al. | 399/49 |
| 2007/0200908 | A1 | 8/2007 | Kin et al. | |
| 2008/0092761 | A1 * | 4/2008 | Kiyohara et al. | 101/335 |
| 2008/0144067 | A1 * | 6/2008 | Burry et al. | 358/1.13 |
| 2008/0260418 | A1 * | 10/2008 | Karagiannis et al. | 399/109 |

(Continued)

FOREIGN PATENT DOCUMENTS

| | | | |
|---|---|---|---|
| JP | H10-198222 | A | 7/1998 |
| JP | 2001-154428 | A | 6/2001 |

(Continued)

OTHER PUBLICATIONS

Oki, Makoto, JP 2002172833 A, Jun. 2002, English Language Machine Translation.*

(Continued)

*Primary Examiner* — Marivelisse Santiago Cordero
*Assistant Examiner* — Daryl Jackson
(74) *Attorney, Agent, or Firm* — Merchant & Gould PC

(57) ABSTRACT

A printing device including a printing unit that prints an image with print agent, a calibration unit that executes a calibration process, a specifying unit that specifies a usage amount of the print agent, and a control unit that controls the calibration unit to execute the calibration process at a lower frequency when the specifying unit specifies a lower amount as the usage amount. The calibration process is for printing a mark with the print unit, detecting the mark, and calculating a calculation value based on a detection result.

12 Claims, 6 Drawing Sheets

(56) References Cited

U.S. PATENT DOCUMENTS

| | | | | |
|---|---|---|---|---|
| 2009/0060538 | A1* | 3/2009 | Higuchi et al. | 399/39 |
| 2009/0161133 | A1* | 6/2009 | Nakamura | 358/1.9 |
| 2009/0245828 | A1* | 10/2009 | Ito | 399/49 |
| 2010/0110460 | A1* | 5/2010 | Miyata | 358/1.9 |
| 2011/0007359 | A1* | 1/2011 | Yamakawa et al. | 358/1.15 |
| 2011/0279835 | A1* | 11/2011 | Tanaka | 358/1.9 |

FOREIGN PATENT DOCUMENTS

| | | | | | |
|---|---|---|---|---|---|
| JP | 2002-172833 | A | | 6/2002 | |
| JP | 2002172833 | A | * | 6/2002 | B41J 29/46 |
| JP | 2003-220727 | A | | 8/2003 | |
| JP | 2006-154371 | A | | 6/2006 | |
| JP | 2006-201608 | A | | 8/2006 | |
| JP | 2006-235237 | A | | 9/2006 | |
| JP | 2006235237 | A | * | 9/2006 | |
| JP | 2007-225982 | A | | 9/2007 | |
| JP | 2007225982 | A | * | 9/2007 | |
| JP | 2008158246 | A | * | 7/2008 | |
| JP | 2008-309920 | A | | 12/2008 | |

OTHER PUBLICATIONS

Kobayashi, Kiyotaka JP2008158246 A, Jul. 2008, English Language Machine Translation.*

Tenijku, JP 2006235237 English Language Machine Translation.*

Japan Patent Office, Office Action for Japanese Patent Application No. 2009-271592 (counterpart to above-captioned patent application), mailed Aug. 23, 2011.

European Patent Office, extended European Search Report for European Patent Application No. 10251370.2 (counterpart to above-captioned patent application), dated Oct. 26, 2011.

The State Intellectual Property Office of the People'S Republic of China, Notification of the First Office Action for Chinese Patent Application No. 201010502733.7 (counterpart Chinese patent application), issued Feb. 21, 2013.

* cited by examiner

FIG.6

TABLE TB

| USER SPECIFIED DENSITY | TONER-SAVE MODE | PRINT DENSITY | TIME INTERVAL T | DEFERMENT OF CALIBRATION |
|---|---|---|---|---|
| 0 | OFF | 0 | 60 MINUTES | NOT-DEFER |
| -1 | OFF | -1 | 90 MINUTES | NOT-DEFER |
| -2 | OFF | -2 | 120 MINUTES | NOT-DEFER |
| -3 | OFF | -3 | 120 MINUTES | NOT-DEFER |
| -4 | OFF | -4 | 150 MINUTES | DEFER |
| -5 | OFF | -5 | 150 MINUTES | DEFER |
| 0 | ON | -4 | 150 MINUTES | DEFER |
| -1 | ON | -5 | 150 MINUTES | DEFER |
| -2 | ON | -5 | 150 MINUTES | DEFER |
| -3 | ON | -5 | 150 MINUTES | DEFER |
| -4 | ON | -5 | 150 MINUTES | DEFER |
| -5 | ON | -5 | 150 MINUTES | DEFER |

PRINTING DEVICE THAT EXECUTES CALIBRATION AT FREQUENCY SUITED TO USER DEMAND

CROSS REFERENCE TO RELATED APPLICATION

This application claims priority from Japanese Patent Application No. 2009-271592 filed Nov. 30, 2009. The entire content of this priority application is incorporated herein by reference.

TECHNICAL FIELD

The present invention relates to a printing device, and more particularly to a printing device having a function that allows a user to specify the usage amount of print agent.

BACKGROUND

When printing images with a printing device having a function to adjust image density, a user can reduce the amount of toner or ink to be used during printing by setting to a lower image density.

Also, Japanese Patent-Application Publication No. H10-198222 discloses a printing device having a save mode. If a user selects the save mode, then the usage amount of toner or ink during printing is reduced by reducing the image density or by thinning out dots or lines.

There is also provided a printing device that automatically executes a calibration process for calibrating a density level or a printing position when a predetermined condition is met. In this calibration process, the printing device prints a predetermined pattern, detects the pattern, and calibrates the density level or the printing position based on detection results.

SUMMARY

If a user emphasizes image quality, then it is desirable that the calibration process be performed prior to printing so as to ensure the appropriate density level and the like. If the user puts not much emphasis on image quality, on the other hand, then frequent execution of the calibration process undesirably consumes more ink or toner.

In view of the foregoing, it is an object of the invention to provide a printing device capable of executing the calibration process at a frequency suited to user demand.

In order to attain the above and other objects, the invention provides a printing device including a printing unit that prints an image with print agent, a calibration unit that executes a calibration process, a specifying unit that specifies a usage amount of the print agent, and a control unit that controls the calibration unit to execute the calibration process at a lower frequency when the specifying unit specifies a lower amount as the usage amount. The calibration process is for printing a mark with the print unit, detecting the mark, and calculating a calculation value based on a detection result.

BRIEF DESCRIPTION OF THE DRAWINGS

The particular features and advantages of the invention as well as other objects will become apparent from the following description taken in connection with the accompanying drawings, in which:

FIG. 6 is a table based on which frequency of calibration is determined in the embodiment of the invention.

DETAILED DESCRIPTION

A printer 1 according to an embodiment of the invention will be described while referring to the accompanying drawings. The terms "right," "left," "beneath," and the like will be used throughout the description assuming that the printer 1 is disposed in an orientation in which it is intended to be used. In use, the printer 1 is disposed as shown in FIG. 1.

The printer 1 of the embodiment is a direct-tandem-type color printer for forming color images with toner (print agent) of four colors (black, yellow, magenta, and cyan). Note that some reference signs denoting components identical for each color are omitted in FIG. 1.

Figure 1:
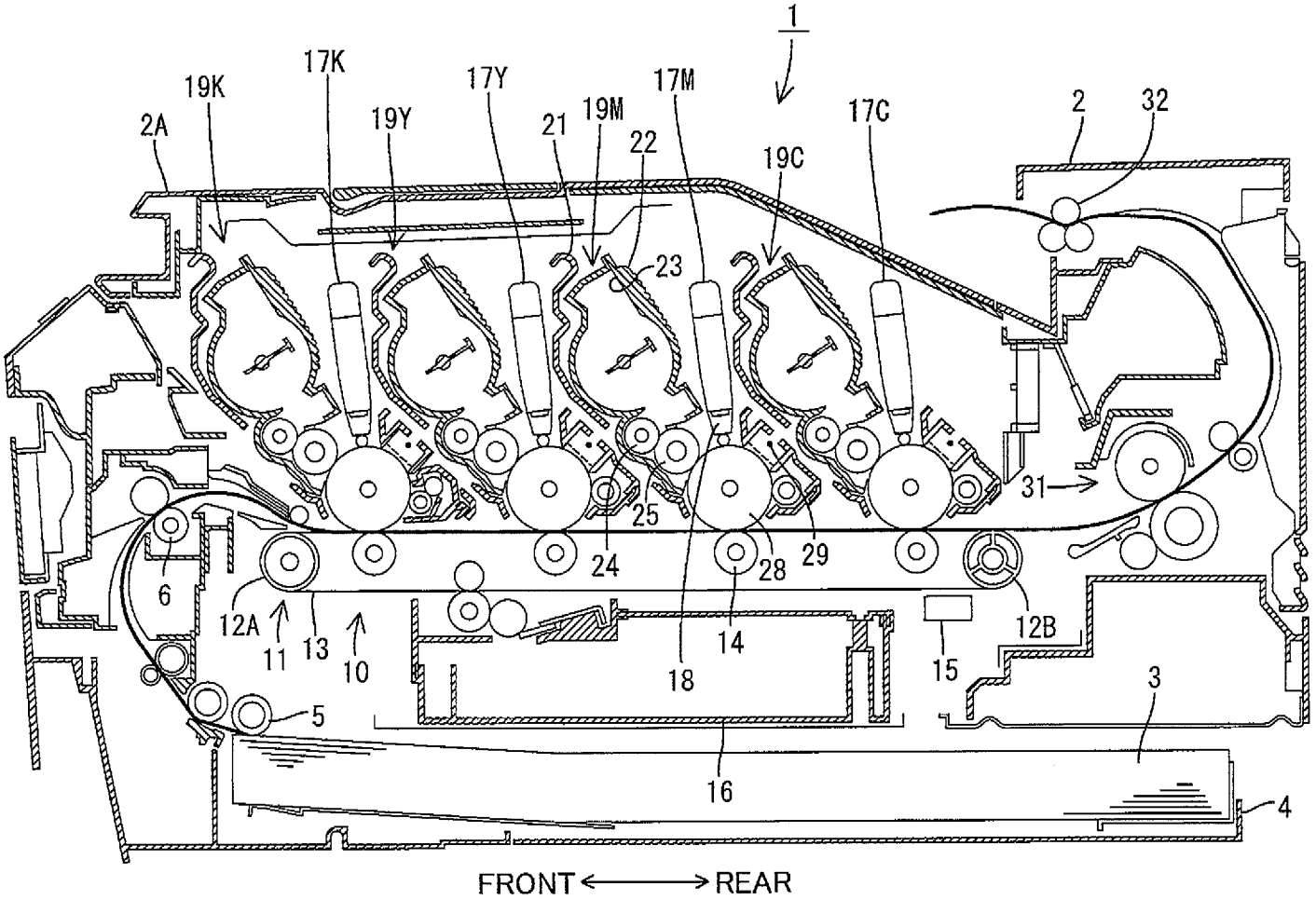
FIG. 1 is a cross-sectional side view of a printer according to an embodiment of the invention.

As shown in FIG. 1, the printer 1 includes a main casing 2 formed with a cover 2A on top thereof. The cover 2A is capable of selectively opening and closing. The printer 1 also includes a supply tray 4, a sheet-feed roller 5, registration rollers 6, and a printing unit 10. The printing unit 10 includes a belt unit 11, exposure units 17K, 17Y, 17M, and 17C, process units 19K, 19Y, 19M, and 19C, and a fixing unit 31.

The supply tray 4 is disposed in the bottom section of the main casing 2 for accommodating a stack of sheets 3 (recording medium). The sheets 3 stacked in the supply tray 4 are fed by the sheet-feed roller 5 and conveyed to the belt unit 11 by the registration rollers 6 one at a time.

The belt unit 11 includes a pair of belt-support rollers 12A and 12B opposing each other in a front-to-rear direction and a ring-shaped belt 13 wound about and spanning between the belt-support rollers 12A and 12B. The belt 13 supports the sheet 3 thereon by electrostatic adsorption, and circulation of the belt 13 conveys the sheet 3 rearward. Four transfer rollers 14 are disposed within the belt 13 at positions confronting photosensitive drums 28 (described later) of the process units 19K, 19Y, 19M, and 19C with an upper part of the belt 13 interposed therebetween.

The exposure units 17K, 17Y, 17M, and 17C respectively correspond to black, yellow, magenta, and cyan, and each includes an LED head 18 having an array of a plurality of LEDs (not shown) at the bottom. Each of the exposure units 17K, 17Y, 17M, and 17C emits a light beam with each LED based on print data and scans the light beam across a surface of the corresponding photosensitive drum 28 one line at a time.

The printer 1 further includes a pattern sensor 15 and a cleaner 16. The pattern sensor 15 is disposed beneath the belt 13 for detecting patterns formed on the surface of the belt 13. The pattern sensor 15 irradiates a light to the surface of the belt 13, receives a reflected light with a phototransistor or the like, and outputs a single of a level corresponding to a received amount of reflected light. The cleaner 16 is disposed beneath the belt unit 11 for collecting toner, paper dust, and the like clinging on the surface of the belt 13.

The process units 19K, 19Y, 19M, and 19C respectively correspond to black, yellow, magenta, and cyan, and each includes a frame 21 and a developing cartridge 22. Opening the cover 2A withdraws the exposure units 17K, 17Y, 17M, and 17C upward, enabling a user to remove or mount each of the exposure units 17K, 17Y, 17M, and 17C from or into the main casing 2 individually. Also, the belt unit 11 can be mounted into or removed from the main casing 2 when all of the process units 19K, 19Y, 19M, and 19C are removed from the main casing 2.

Each developing cartridge 22 includes a toner chamber 23, a supply roller 24, and a developing roller 25. The toner chamber 23 accommodates toner of corresponding color. Toner discharged from the toner chamber 23 is supplied to the developing roller 25 by rotation of the supply roller 24, and is tribocharged to a positive polarity at a position between the supply roller 24 and the developing roller 25.

The photosensitive drum 28 and a charger 29 are disposed in the lower section of each frame 21. The photosensitive drum 28 is formed of an electrically-grounded column-shaped main body having a surface coated with a positively-chargeable photosensitive layer. The charger 29 generates a discharge to uniformly charge the surface of the rotating photosensitive drum 28 to a positive polarity. Thus uniformly charged surface of the photosensitive drum 28 is exposed to a scanning of the light beam emitted from the exposure unit 17K, 17Y, 17M, or 17C. As a result, the surface electric potential of the photosensitive drum 28 partially decreases by an amount corresponding to the intensity of the light beam. In this manner, an electrostatic latent image corresponding to an image to be formed on the sheet 3 is formed on the photosensitive drum 28.

Then, positively-charged toner held on the developing roller 25 is selectively supplied to the electrostatic latent image formed on the photosensitive drum 28 by a developing bias applied to the developing roller 25. As a result, the electrostatic latent image on the photosensitive drum 28 is transformed into a visible toner image.

The toner images formed on the photosensitive drums 28 in this manner are sequentially transferred onto the sheet 3 so as to be superimposed over each other by a transfer bias applied to the transfer rollers 14 when the sheet 3 passes through transfer positions between the photosensitive drums 28 and the transfer rollers 14. The sheet 3 with the toner images formed thereon is conveyed to the fixing unit 31 located in the rear section of the main casing 2. The fixing unit 31 thermally fixes the toner images onto the sheet 3 and discharges the sheet 3 upward. Thereafter, the sheet 3 is discharged onto a top surface of the main casing 2 by discharge rollers 32.

Figure 2:
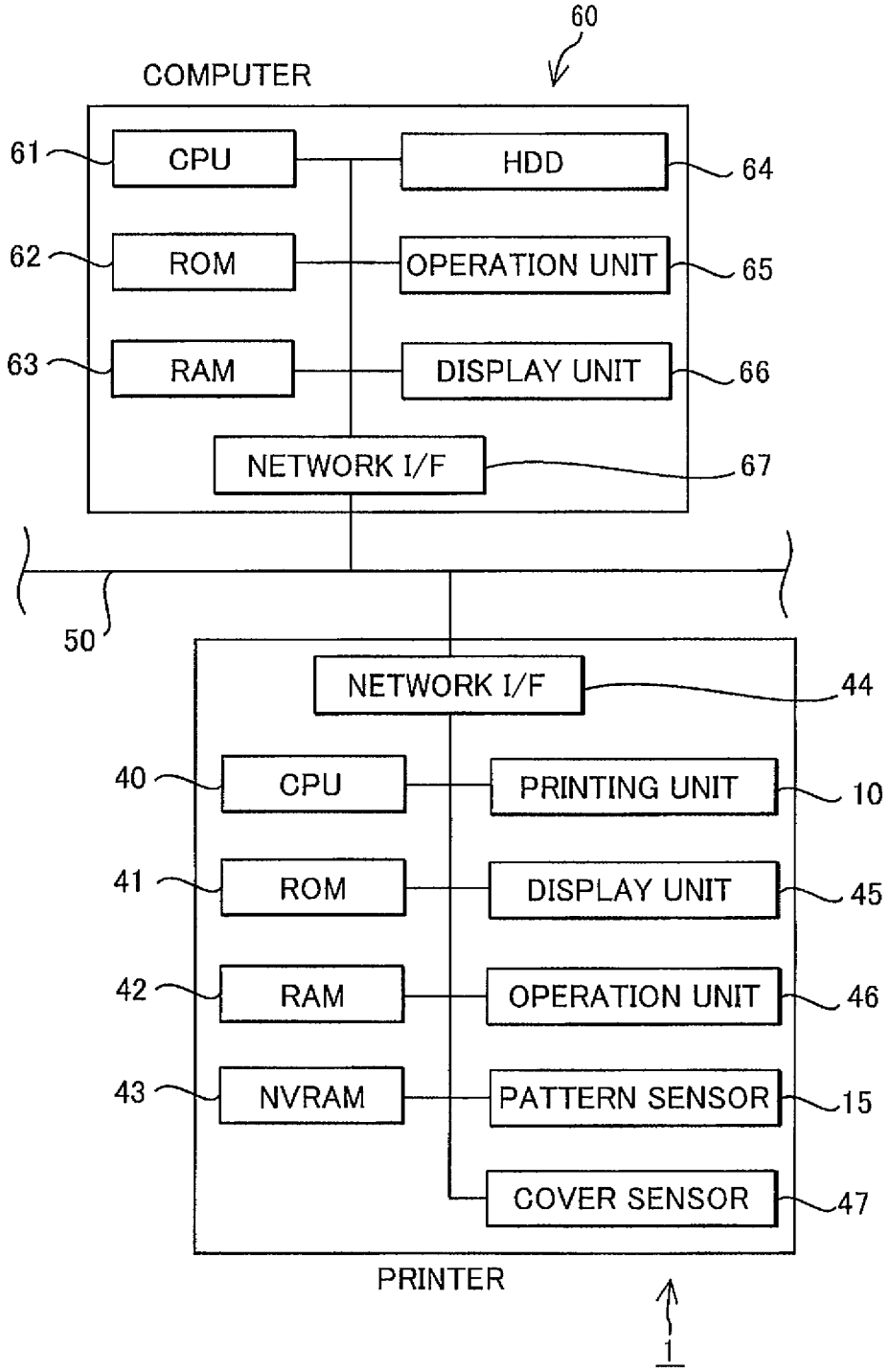
FIG. 2 is a block-diagram of the printer according to the embodiment of the invention and an external computer connected thereto.

As shown in FIG. 2, the printer 1 further includes a CPU 40, a ROM 41, a RAM 42, a non-volatile RAM (NVRAM) 43, and a network interface (I/F) 44. The ROM 41 stores various programs for executing various operations in the printer 1. The CPU 40 executes overall control of the printer 1 based on programs read from the ROM 41 while storing processed results into either the RAM 42 or the NVRAM 43. The network I/F 44 (a specifying unit, an input unit, an accepting unit) is connected to an external computer 60 and the like through a communication circuit 50 to establish data communication therebetween.

The printer 1 also includes a display unit 45, an operation unit 46, and a cover sensor 47. Although not shown in the drawings, the display unit 45 includes a display panel and a lamp, and is capable of displaying various setting screens and operation status of the printer 1. The operation unit 46 (a specifying unit, an input unit, an accepting unit) includes various buttons (not shown) through which a user can input various instructions. The cover sensor 47 outputs a detection signal indicating an open or closed status of the cover 2A.

The printer 1 has a toner-save mode, and a user can manipulate the operation unit 46 to selectively turn ON and OFF the toner-save mode. The user also can specify a desired image density (usage amount of print agent) and input a calibration execution command through the operation unit 46. Details will be described later.

The computer 60 includes a CPU 61, a ROM 62, a RAM 63, a hard disk drive (HDD) 64, an operation unit 65 including a keyboard and a pointing device (not shown), a display unit 66 including a display panel (not shown), and a network I/F 67 connected to the communication circuit 50. The HDD 64 stores various programs including an application software for generating image data to be printed and a printer driver for controlling the printer 1.

When a user instructs print execution on the operation unit 65 of the computer 60, a print command is transmitted from the computer 60 to the printer 1 and received by the CPU 40 through the network I/F 44. When instructing the print execution, the user can have the display unit 66 display a print setting screen of the printer driver and input various print-condition settings on the print setting screen. These settings are transmitted to the printer 1 along with the print command. In this embodiment, a user can set a print quality (resolution) to either normal quality (normal resolution) or high quality (high resolution), and this quality setting is transmitted to the printer 1 along with the print command.

Next, a printing/calibration process executed in the printer 1 will be described with reference to the flowchart of FIG. 3. In this printing/calibration process, the printer 1 selectively executes a printing process and a calibration process. The calibration process is a process to perform calibration that affects image quality. In this embodiment, the calibration process includes a density level calibration process and a printing position calibration process. The printer 1 executes the printing/calibration process of FIG. 3 repeatedly while a main power of the printer 1 is ON.

First in S101, the CPU 40 determines whether or not any of the process units 19K, 19Y, 19M, and 19C has been detached and attached. In this embodiment, the CPU 40 makes a positive determination in S101 if opening/closing of the cover 2A is detected by the cover sensor 47. If a negative determination is made in S101 (S101: No), then the CPU 40 directly proceeds to S103. On the other hand, if a positive determination is made in S101 (S101: Yes), then the CPU 40 executes both the density level calibration process and the printing position calibration process in S102 and then proceeds to S103.

Figure 5:
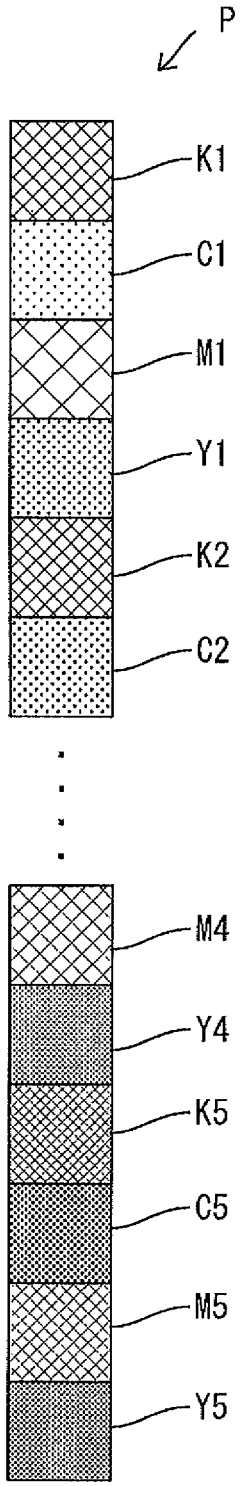
FIG. 5 is a view showing an example of density pattern printed with the printer.

In the density level calibration process, first the CPU 40 controls the printing unit 10 to print a density pattern P shown in FIG. 5, for example, on the belt 13. The density pattern P includes a plurality of patches (marks) aligned along the circulation direction of the belt 13. More specifically, the density pattern P includes five patches for each of the colors black, yellow, magenta, and cyan formed in different densities (black patches K1 to K5, cyan patches C1 to C5, magenta patches M1 to M5, and yellow patches Y1 to Y5, some of which are omitted from FIG. 5).

Next, the CPU 40 measures the density of each patch with the pattern sensor 15. Then, based on the measurement results, the CPU 40 calculates density calibration data for realizing an ideal image density when printing images on the sheet 3, for each of 256 tones (density of 0% to 100% is equally divided into 256 tones) of each color, and stores each density calibration data into the NVRAM 43 for later use. That is, when printing images, the CPU 40 retrieves the density calibration data from the NVRAM 43 and sets the intensity of the light beam and the developing bias voltage based on the density calibration data to calibrate image density. The toner forming the density pattern P is removed from the belt 13 by the cleaner 16.

In the printing position calibration process, on the other hand, first the CPU 40 prints on the belt 13 a position-calibration pattern (not shown) including a plurality of marks of each color with the printing unit 10 and then detects a position of each mark with the pattern sensor 15. Based on the detection results, the CPU 40 calculates a positional offset amount from an ideal position for each color, calculates position calibration data for compensating the positional offset for each color, and stores the position calibration data into the NVRAM 43 for later use. That is, when printing images, the CPU 40 retrieves the position calibration data from the NVRAM 43 and controls the scanning start timings of the light beams from the exposure units 17K, 17Y, 17M, and 17C based on the retrieved position calibration data so as to calibrate the printing positions.

In S103, the CPU 40 determines whether or not a calibration execution command is received. As described above, the calibration execution command may be input by a user through the operation unit 46. However, the user may alternatively input the calibration execution command by using such programs as the printer driver executable on the computer 60. In this case, the calibration execution command is transmitted from the computer 60 to the printer 1 through the network I/F 44.

If a negative determination is made in S103 (S103: No), then the CPU 40 directly proceeds to S105. On the other hand, if a positive determination is made in S103 (S103: Yes), then the CPU 40 executes the density level calibration process and the printing position calibration process described above in S104, and then proceeds to S105.

Note that the CPU 40 may execute only either one of the density level calibration process and the printing position calibration process in S104. Also, the user may specify either the density level calibration process or the printing position calibration process to be executed in S104.

In S105, the CPU 40 executes a calibration execution process, which will be described next with reference to the flowchart of FIG. 4.

Figure 4:
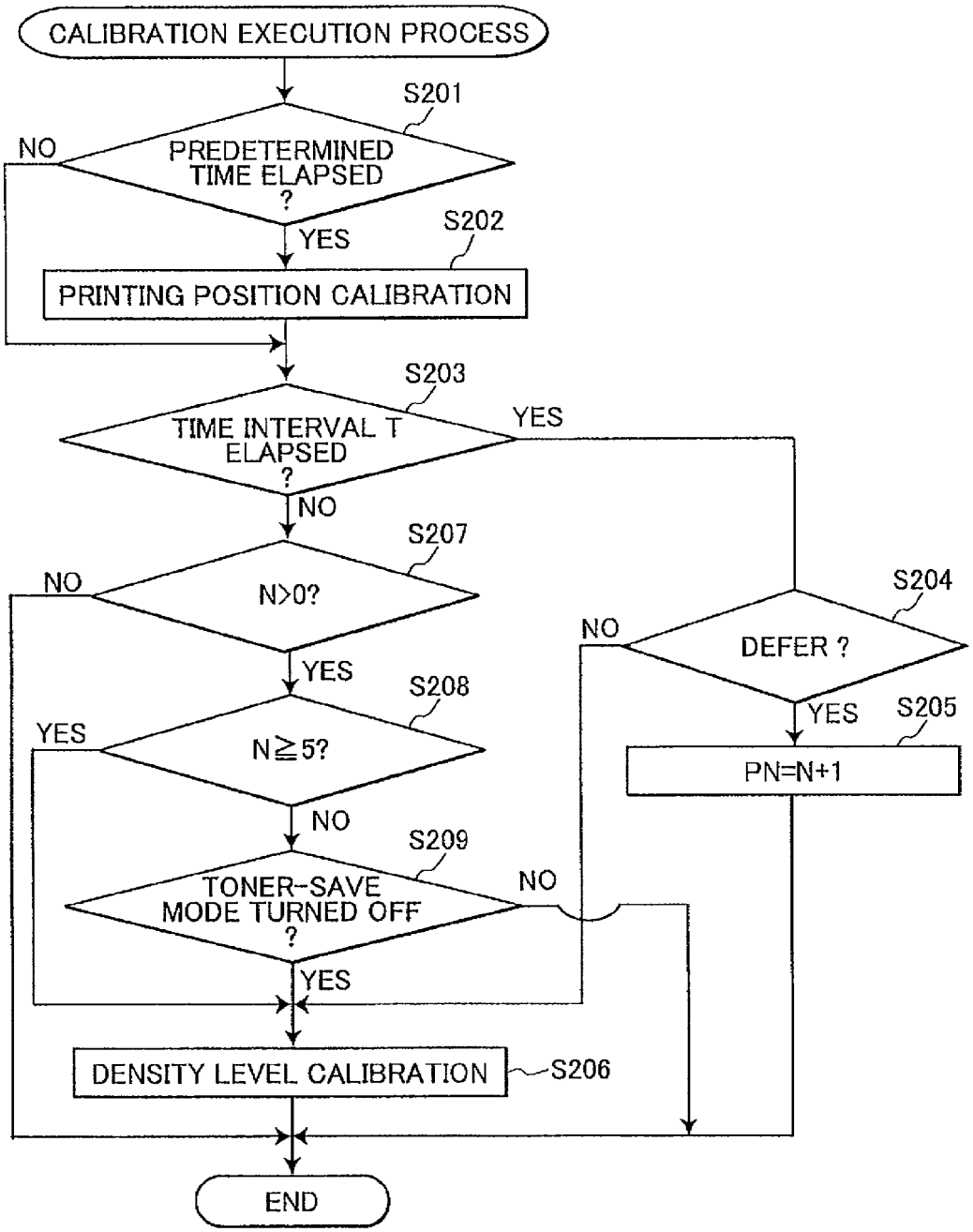
FIG. 4 is a flowchart representing a calibration execution process executed in the printer according to the embodiment of the invention.

In S201 of FIG. 4, first in S201 the CPU 40 determines whether or not a predetermined condition to execute the printing position calibration process is met. In this embodiment, an elapse of a predetermined time since the printing position calibration process was executed last time is set as the condition to execute the printing position calibration process. Thus, a positive determination is made in S201 if the predetermined time has elapsed since the printing position calibration process was executed last time. However, the condition to execute the printing position calibration process may be changed as needed. For example, it is possible to set the condition such that a positive determination is made in S201 if images have been printed on a predetermined number of sheets 3 since the printing position calibration process was executed last time or if the amount of temperature change since the printing position calibration process was executed last time has reached a predetermined amount.

If a positive determination is made in S201 (S201: Yes), then the CPU 40 executes the printing position calibration process in S202, and then proceeds to S203. On the other hand, if a negative determination is made in S201 (S201: No), then the CPU 40 directly proceeds to S203.

In S203, the CPU 40 determines whether or not a condition to execute the density level calibration process is met. In this embodiment, a positive determination is made in S203 if a time interval T has elapsed since either when the density level calibration process was executed last time or when execution of the density level calibration process was deferred last time. Note that deferment of the density level calibration process means ending the calibration execution process of FIG. 4 without executing the density level calibration process when a positive determination is made in S203 as described later (process to proceed to S205 after S204 (S204: Yes)).

The time interval T is determined based on a user-specified density, an ON/OFF setting of the toner-save mode, and a table TB shown in FIG. 6. The table LB will be described in detail. The table TB indicates a print density, the time interval T, and deferment of calibration, for each combination of the user-specified densities and the ON/OFF settings of the toner-save mode. As described above, a user can set a desired image density (hereinafter referred to as "user-specified density") and ON/OFF of the toner-save mode through the operation unit 46.

However, the user may alternatively set the user-specified density and ON/OFF of the toner-save mode on the computer 60. For example, the computer 60 displays on the display unit 66 a print-setting screen of the printer driver to enable the user to specify a desired user-specified density and to indicate an ON/OFF of the power-save mode. In this case, when the user instructs print execution, then these settings made on the print-setting screen are transmitted to the printer 1 through the communication circuit 50 together with a print command and various print-condition settings.

In this embodiment, the user can set the user-specified density to a level between +5 and −5 (some of which are omitted from FIG. 6), and the print density can be set to a level between +5 to −5. When the toner-save mode is ON, then the print density is the same as the user-specified density. On the other hand, when the toner-save mode is OFF, then the print density is equal to a difference obtained by subtracting 4 from the user-specified density. However, if the difference is −6 or less, then the print density is set to −5. In actual printing, the CPU 40 controls the intensity of the light beam from the LEDs and the like based on one of the print densities listed on the table TB corresponding to the current combination of the user-specified density and the ON/OFF setting of the toner-save mode to realize the target print density.

The time interval T is set longer for a lower user-specified density when the toner-save mode is OFF. For example, the time interval T is 60 minutes when the user-specified density is 0, 90 minutes when the user-specified density is −1, 120 minutes when the user-specified density is −2 or −3, and 150 minutes when the user-specified density is −4 or −5. In other words, the condition to execute the density level calibration process is stricter (met less often) when a lower toner usage amount is specified by the user. On the other hand, when the toner-save mode is ON, the time interval T is always 150 minutes regardless of the user-specified density.

Also, the table TB indicates either "defer" or "not defer" in a deferment column. In this embodiment, "deter" is set when the print density is −4 or less, and "not defer" is set when the print density is −3 or greater.

Thus, in S203 of FIG. 4, the CPU 40 refers to the table TB and determines the time interval T corresponding to the current combination of the user-specified density and the ON/OFF setting of the toner-save mode that have been previously input by the user, and determines whether or not the time interval T has elapsed since either when the density level calibration process was executed last time or when execution of the density level calibration process was deferred last time.

If a positive determination is made in S203 (S203: Yes), then in S204 the CPU 40 refers to the table TB and determines whether or not the deferment of calibration is set to "defer" for the current combination of the user-specified density and the ON/OFF setting of the toner-save mode. If so (S204: Yes), then the CPU 40 increments a counter N by 1 and ends the calibration execution process without executing the density level calibration process. That is, the CPU 40 defers execution of the density level calibration process. On the other hand, if a negative determination is made in S204 (S204: No), then the CPU 40 executes the density level calibration process in S206 and ends the calibration execution process. Note that the CPU 40 resets the counter N to 0 each time the CPU 40 executes the density level calibration process, not only in S206, but also in S102, 104, and S108 of FIG. 3.

If a negative determination is made in S203 (S203: No), then in S207 the CPU 40 determines whether or not the counter N is greater than 0. If not (S207: No), then this means that the density level calibration process has not been deterred after the density level calibration process was executed last time. In this case, the CPU 40 ends the calibration execution process. On the other hand, if so (S207: Yes), then this means that the density level calibration process has been deterred after the density level calibration process was executed last time. In this case, the CPU 40 determines in S208 whether or not the counter N is 5 or greater. If so (S208: Yes), then the CPU 40 proceeds to S206 to execute the density level calibration process. That is, if the density level calibration process has been deferred five times, then the density level calibration process is executed.

If a negative determination is made in S208 (S208: No), on the other hand, then the CPU 40 determines in S209 whether or not the toner-save mode has been switched from ON to OFF. If so (S209: Yes), then the CPU 40 proceeds to S206 to execute the density level calibration process. In other words, the density level calibration process is executed at a timing of when the toner-save mode is switched from ON to OFF. However, if not (S209: No), then the CPU 40 ends the calibration execution process without executing the density level calibration process.

Figure 3:
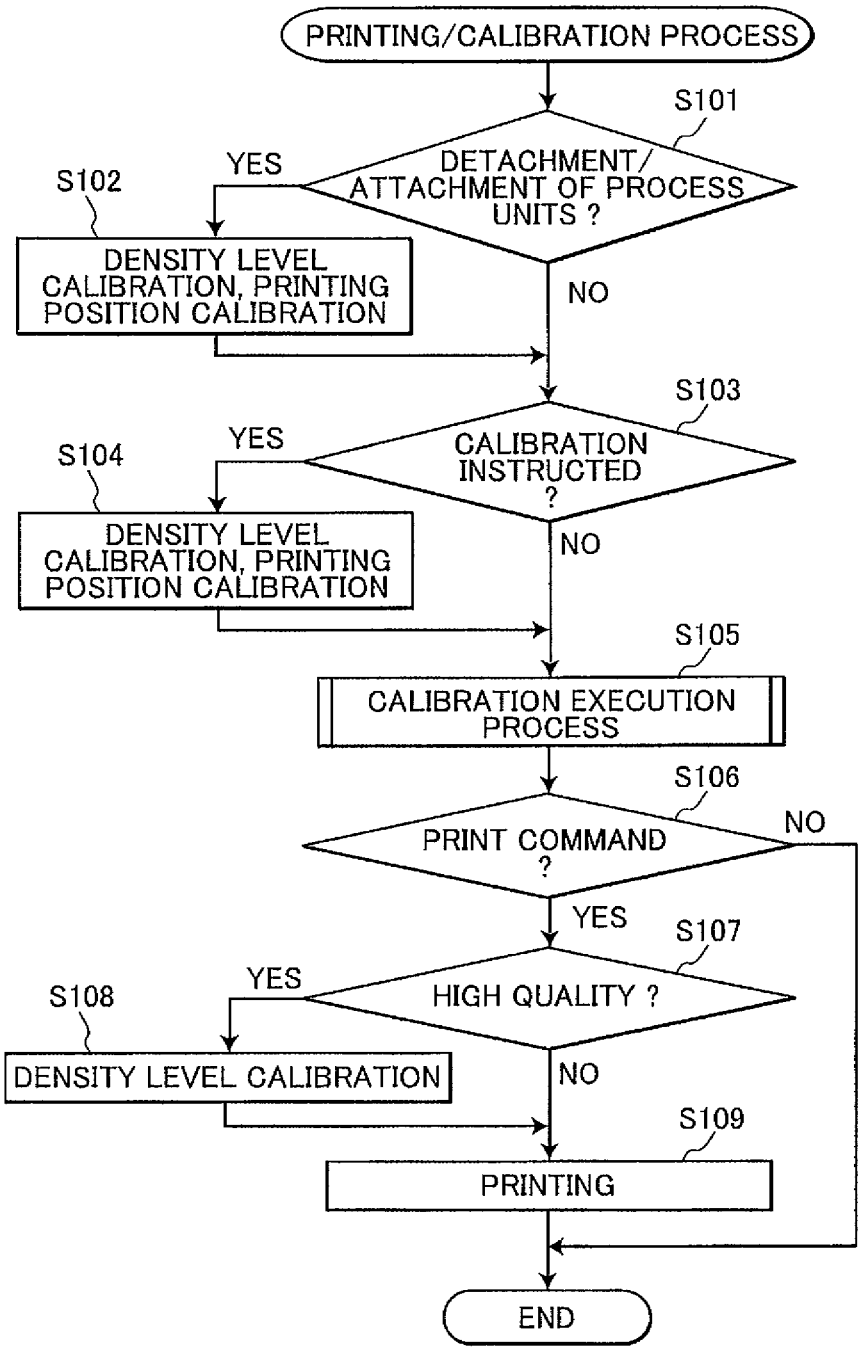
FIG. 3 is a flowchart representing a printing/calibration process executed in the printer according to the embodiment of the invention.

After executing the calibration execution process in S105 of FIG. 3, the CPU 40 determines in S106 whether or not a print command is received. If not (S106: No), then the CPU 40 ends the process of FIG. 3. On the other hand, if so (S106: Yes), then in S107 the CPU 40 determines whether or not the quality setting received together with the print command is high quality. If so (S107: Yes), then the CPU 40 executes the density level calibration process in S108 and proceeds to S109. On the other hand, if not (S107: No), then the CPU 40 directly proceeds to S109. In other words, execution of the density level calibration process in S108 is allowed if the image quality is set to high quality, but is not allowed if the image quality is set to normal quality.

In S109, the CPU 40 controls the printing unit 10 to execute printing based on the print command. Then, the CPU 40 ends the printing/calibration process.

As described above, according to the present embodiment, the printing position calibration process is executed in S202 of FIG. 4 once each time the predetermined time elapses unless the printing position calibration process is executed in either S102 or S104. On the other hand, the frequency of the density level calibration process executed in S206 is determined based on the combination of the user-specified density and the ON/OFF of the toner-save mode, unless the density level calibration process is executed in either S102, S104, or S108.

That is, if "not defer" is set in the table TB, then the time interval T is longer when the user-specified density is lower, so the density level calibration process is executed less frequently. Also, when the toner-save mode is ON, execution of the density level calibration process may be deferred. Thus, the density level calibration process is executed less frequently compared to when the toner-save mode is OFF.

Also, the printing position calibration process and the density level calibration process are executed each time detachment/attachment of the process units 19K, 19Y, 19M, and 19C is detected (S101: Yes) and each time the calibration execution command is received (S103: Yes). Further, the density level calibration process is executed when a print command is received if the image quality is set to high quality (S107: Yes). That is, in these cases, the density level calibration process is executed regardless of any determination results made in the calibration execution process of FIG. 4.

As described above, according to the present embodiment, a calibration process (density level calibration process) is executed less frequently when the specified usage amount (image density) of print agent (toner) is smaller. Generally, it is assumed that a user more likely emphasizes saving the print agent over image quality when a lower usage amount of print agent is specified (when the user-specified density is lower). Thus, setting lower frequency for the density level calibration process when a smaller usage amount is specified enables to execute the density level calibration process at a frequency suited to user demand.

Also, according to the above-described embodiment, a condition to execute the calibration process is stricter when a lower usage amount of print agent is specified. This enables to lower the frequency of the density level calibration process when the usage amount of print agent is set to a lower amount.

Also, when the usage amount of print agent specified by a user is equal to or less than a predetermined amount, then the execution of the calibration process may be deferred even if the condition to execute the calibration process is met. This lowers the frequency of the calibration process, and thus reduces the consumption of print agent.

Also, when the toner-save mode is turned OFF (in other words, when the specified usage amount of print agent is increased; S209: Yes) after the calibration process was deferred (S207: Yes), then the calibration process is executed. That is, it is highly likely that the image quality is emphasized over saving the print agent if the usage amount of print agent is increased. Thus, in this case, the calibration process is executed upon detecting turning OFF of the toner-save mode to meet user demand.

Further, the calibration process is executed upon increase of the usage amount of print agent, regardless of whether or not a print command has been received. Thus, when a print command is received afterward, printing based on the print command can be executed quickly without being delayed by execution of the calibration process, while securing high-quality image.

Moreover, when the calibration execution command is input, then the calibration process is always executed, without regard to settings regarding execution of the calibration process (i.e., the time interval T and/or deferment of calibration). With this configuration, the calibration process is executed based on a user command even if the setting is to lower the frequency of the calibration process, and thus it is possible to enhance the convenience.

Also, when a print command for a high-quality image is received, then the calibration process is always executed, without regard to the settings regarding execution of the calibration process. This configuration ensures high-quality images to meet user demand.

When attachment conditions of the components of the printing unit 10 to the main casing 2 are changed, there is a danger of greatly degrading image quality, if images are printed without executing the calibration process. Thus, according to the above-described embodiment, if the cover sensor 47 detects the attachment/detachment of the process units 19K, 19Y, 19M, and 19C, the calibration process is always executed, without regard to the settings regarding execution of the calibration process. This configuration prevents degradation of image quality.

Generally, it is expected that positional deviations affect image quality more than density deviations do. Thus, in the above-described embodiment, the frequency of the printing position calibration process is not lowered even when the usage amount of print agent is set low, although the frequency of the density level calibration process is lowered in accordance with the usage amount of print agent. Thus, it is possible to reduce the overall frequency of the calibration process (the printing position calibration process and the density level calibration process combined) while maintaining a certain level of image quality.

While the invention has been described in detail with reference to the embodiment thereof, it would be apparent to those skilled in the art that various changes and modifications may be made therein without departing from the spirit of the invention.

For example, the printer 1 is not limited to an electrophotographic color printer, but may be a monochrome printing device, an inkjet printing device, or different type of printing device. Also, the print agent may be ink or the like.

In the above-described embodiment, the usage amount of print agent is specified by a user specifying the image density and turning ON/OFF the toner-save mode. However, it may be configured to enable the user to either specify the image density or turn ON/OFF the toner-save mode. Also, in the above-described embodiment, the usage amount of print agent is decreased by lowering the image density. However, the usage amount of print agent may be decreased by thinning out dots or lines.

In the above-described embodiment, the frequency of the calibration process is adjusted based on the time interval T and "defer" or "not deter" set in the table TB shown in FIG. 6. However, the frequency may be adjusted based on only one of these two. Also, the printing position calibration process also may be executed at a frequency determined based on the usage amount of print agent.

In the above-described embodiment, the calibration process is executed after the calibration process has been deferred a predetermined number of times (five times in the embodiment). However, the predetermined number can be changed arbitrary or may not be used. For example, it is possible to set a larger number for a lower usage amount of print agent, such that the frequencies are changed in steps. It is also possible to prohibit execution of the calibration process when the frequency of the calibration process is lowered.

In the above-described embodiment, the calibration process is executed upon increase of the usage amount of print agent after deferment of the calibration process. However, when the usage amount of print agent is increased, it is possible to wait for a next print command without immediately executing the calibration process and to execute the calibration process upon receiving a next print command immediately before printing based on the next print command. It is also possible to enable a user to select either to execute the calibration process immediately or to wait until a next print command is received.

In the above-described embodiment, it is determined that the process units 19K, 19Y, 19M, and 19C are detached/attached when the cover sensor 47 detects the opening/closing of the cover 2A. However, it is possible to determine that the process units 19K, 19Y, 19M, and 19C are detached/attached when an amount of remaining toner is detected to be changed with a toner sensor, for example. Also, the calibration process can be executed when detachment/attachment of such other components as the belt unit 11 of the printing unit 10 is detected.

Oscillation or impact applied to the printer 1 also may change the attachment condition of the components, which in turn affects image quality. Thus, it is possible to automatically execute the calibration process when vibration greater than a predetermined level is detected in the printer 1 with a vibration sensor, regardless of the settings regarding the frequency of the calibration process.

What is claimed is:

1. A printing device comprising:

a belt;

a belt sensor disposed adjacent to the belt;

a specifying unit operated by a user and configured to specify a toner-save mode ON or OFF;

a communication unit configured to communicate with an external computer configured to specify the toner-save mode ON or OFF;

a printing unit configured to print an image with less amount of print agent while the toner-save mode ON is specified by at least one of the specifying unit and the external computer than while the toner-save mode OFF is specified by at least one of the specifying unit and the external computer; and a control unit configured to execute a density level calibration process at a first frequency when the toner-save mode ON is specified by at least one of the specifying unit and the external computer, and to execute the density level calibration process at a second frequency when the toner-save mode OFF is specified by at least one of the specifying unit and the external computer;

wherein the first frequency corresponds to a first amount of time between the density level calibration processes and the second frequency corresponds to a second amount of time between the density level calibration processes, the first amount of time being longer than the second amount of time, and wherein the control unit is further configured to perform the density level calibration process by:

controlling the printing unit to print a calibration image on the belt;

controlling the belt sensor to detect the calibration image printed on the belt;

generating a calibration data based on a detection result of the belt sensor; and storing the generated calibration data in the storing unit.

2. The printing device according to claim 1, wherein the control unit counts a number of deferment times that the density level calibration process is deferred, wherein the control unit is configured to determine the execution of the density level calibration process when the number of deferment times exceeds a predetermined number of deferment times, wherein the control unit is configured to determine the deferment of the density level calibration process when the number of deferment times is equal to zero.

3. A printing device comprising:

a belt;

a belt sensor disposed adjacent to the belt;

a specifying unit operated by a user and configured to specify a first density or a second density lower than the first density;

a communication unit configured to communicate with an external computer configured to specify the first density or the second density;

a printing unit configured to print an image with the first density when the first density is specified by at least one of the specifying unit and the external computer and the second density when the second density is specified by at least one of the specifying unit and the external computer; and a control unit configured to execute a density level calibration process at a first frequency when the first density is specified by at least one of the specifying unit and the external computer, and to execute the density level calibration process at a second frequency when second density is specified by at least one of the specifying unit and the external computer, wherein the first frequency corresponds to a first amount of time between the density level calibration processes and the second frequency corresponds to a second amount of time between the density level calibration processes, the first amount of time being longer than the second amount of time, wherein the control unit is further configured to perform the density level calibration process by:

controlling the printing unit to print a calibration image on the belt;

controlling the belt sensor to detect the calibration image printed on the belt;

generating a calibration data based on a detection result of the belt sensory; and storing the generated calibration data in the storing unit.

4. A printing device comprising:

a belt;

a belt sensor disposed adjacent to the belt;

a specifying unit operated by a user and configured to specify a toner-save mode ON or OFF;

a communication unit configured to communicate with an external computer configured to specify the toner-save mode ON or OFF;

a printing unit configured to print an image with less amount of print agent the toner-save mode ON is specified by at least one of the specifying unit and the external computer than while the toner-save mode OFF is specified by at least one of the specifying unit and the external computer;

a storing unit that stores a table representing a relationship between a plurality of frequencies of a calibration process and ON or OFF of the toner-save mode in one-to-one correspondence with the plurality of frequencies, including a first frequency corresponding to the OFF of the toner-save mode, and a second frequency corresponding to the ON of the toner-save mode, the second frequency being lower than the first frequency; and a control unit configured to determine an execution of the calibration process at the first frequency based on the table if the toner-save mode OFF is specified by at least one of the specifying unit and the external computer, and determine an execution of the calibration process at the second frequency based on the table if the toner-save mode ON is specified by at least one of the specifying unit and the external computer, wherein the control unit is further configured to perform the calibration process by:

controlling the printing unit to print a calibration image on the belt;

controlling the belt sensor to detect the calibration image printed on the belt;

generating a calibration data based on a detection result of the belt sensor; and storing the generated calibration data in the storing unit.

5. The printing device according to claim 4, wherein the control unit determines whether to defer an execution of the calibration process and counts a number of deferment times that the calibration process is deferred, wherein the control unit is configured to determine the calibration process when the number of deferment times exceeds a predetermined number of deferment times, wherein the control unit is configured to determine the deferment of the calibration process when the number of deferment times is equal to zero.

6. The printing device according to claim 4, wherein the control unit executes the calibration process in response to turning the toner-save mode from ON to OFF during a period from an execution of the calibration process to an execution of a subsequent calibration process.

7. The printing device according to claim 4, wherein the control unit is configured to receive a calibration command for executing the calibration process, wherein the control unit executes the calibration process in response to a reception of the calibration command during a period from an execution of the calibration process to an execution of a subsequent calibration process.

8. The printing device according to claim 4, wherein the control unit is configured to perform another calibration process and receive a command for executing the calibration process, and wherein the control unit executes the another calibration process in response to a reception of the command for executing the another calibration process during a period from an execution of the calibration process to an execution of a subsequent calibration process, wherein the control unit executes the calibration process in response to a reception of the command for executing the calibration process during the period.

9. The printing device according to claim 8, wherein the control unit is configured to receive a print command for performing a printing process, wherein the control unit executes the another calibration process of the calibration process upon the reception of the command before the printing process.

10. The printing device according to claim 4, wherein the printing unit includes a cartridge configured to accommodate print agent therein, wherein the printing device further comprises a casing in which the cartridge is attached and detecting unit that detects change in attaching condition of the cartridge to the casing, wherein the control unit executes the calibration process in response to a detection of the change in attaching condition of the cartridge by the detecting unit during a period from an execution of the calibration process to an execution of a subsequent calibration process.

11. The printing device according to claim 4, wherein:

the calibration process includes a density level calibration process and a printing position calibration process;

the control unit is configured to perform a density level calibration process by:

controlling the printing unit to print a density level calibration image on the belt;

controlling the belt sensor to detect the density level calibration image printed on the belt; and storing in the storing unit density level calibration data based on a detection result of the belt sensor, the control unit is configured to perform the printing position calibration process by:

controlling the printing unit to print a printing position calibration image on the belt;

controlling the belt sensor to detect the printing position calibration image printed on the belt; and storing in the storing unit position calibration data based on a detection result of the belt sensor, the control unit executes only the printing position calibration process when the toner-save mode is ON.

12. The printing device according to claim 4, wherein the control unit is configured to determine a deferment of the calibration process when the toner-save mode ON is specified by at least one of the specifying unit and the external computer.

* * * * *